US008016156B2

(12) United States Patent
Sawin et al.

(10) Patent No.: US 8,016,156 B2
(45) Date of Patent: Sep. 13, 2011

(54) CLEANSING WIPE CONTAINER HAVING CONTENT-SPECIFIC DISPLAY

(75) Inventors: Philip Andrew Sawin, Cincinnati, OH (US); Kilian John O'Neill, Falkenstein (DE); Yolanda Christina Kennish, Frankfurt (DE)

(73) Assignee: The Procter & Gamble Company, Cincinnati, OH (US)

( * ) Notice: Subject to any disclaimer, the term of this patent is extended or adjusted under 35 U.S.C. 154(b) by 42 days.

(21) Appl. No.: 12/579,670

(22) Filed: Oct. 15, 2009

(65) Prior Publication Data

US 2010/0025416 A1 Feb. 4, 2010

(51) Int. Cl.
*A47F 1/04* (2006.01)

(52) U.S. Cl. ..... 221/155; 221/46; 221/49; 221/197

(58) Field of Classification Search ..... 221/46, 221/49, 155, 197
See application file for complete search history.

(56) References Cited

U.S. PATENT DOCUMENTS 953,471 A 3/1910 Kuhn
3,160,337 A 12/1964 Nelson
3,969,830 A * 7/1976 Grasham ..... 380/54
(Continued)

FOREIGN PATENT DOCUMENTS

AU 513 140 B3 4/1981
(Continued)

OTHER PUBLICATIONS

International Search Report, dated Jan. 30, 2008, 4 pages.
(Continued)

*Primary Examiner* — Timothy R Waggoner
(74) *Attorney, Agent, or Firm* — John G. Powell; Richard L. Alexander

(57) ABSTRACT

A cleansing wipe container includes a bottom panel, a front panel, a rear panel, a pair of side panels and a lid. The cleansing wipe container may be filled with a plurality of cleansing wipes that are contained in a cartridge. The cartridge and container interact such that a message is displayed on or through a panel of the container. The message is based on the cartridge of wipes and may include a type of wipe, a list of ingredients of the wipes, and/or instructions for using the wipes.

12 Claims, 5 Drawing Sheets

U.S. PATENT DOCUMENTS

| | | | | | |
|---|---|---|---|---|---|
| 4,543,139 | A | | 9/1985 | Freedman et al. | |
| 4,863,064 | A | | 9/1989 | Dailey, III | |
| 5,369,261 | A | * | 11/1994 | Shamir | 235/469 |
| 5,542,567 | A | | 8/1996 | Julius | |
| 5,636,741 | A | | 6/1997 | O'Keefe | |
| 5,687,875 | A | * | 11/1997 | Watts et al. | 221/45 |
| 5,715,316 | A | * | 2/1998 | Steenblik et al. | 380/54 |
| 5,957,325 | A | | 9/1999 | Montanez | |
| 5,967,665 | A | | 10/1999 | MacDonald et al. | |
| 6,084,526 | A | | 7/2000 | Blotky et al. | |
| 6,158,614 | A | * | 12/2000 | Haines et al. | 221/63 |
| 6,412,656 | B1 | | 7/2002 | Placik | |
| 6,502,986 | B1 | | 1/2003 | Bensur et al. | |
| 6,520,331 | B2 | * | 2/2003 | Okin et al. | 221/48 |
| 6,529,446 | B1 | | 3/2003 | de la Huerga | |
| 6,540,084 | B2 | | 4/2003 | Silvers | |
| 6,554,134 | B1 | | 4/2003 | Guibert | |
| 6,698,928 | B2 | | 3/2004 | Miller | |
| 6,749,437 | B2 | | 6/2004 | Chan | |
| 6,767,604 | B2 | | 7/2004 | Muir, Jr. et al. | |
| 6,920,999 | B2 | * | 7/2005 | Taylor et al. | 221/154 |
| 7,028,840 | B2 | | 4/2006 | Huang et al. | |
| 7,185,761 | B2 | | 3/2007 | Molina et al. | |
| 2005/0171634 | A1 | | 8/2005 | York et al. | |
| 2005/0263534 | A1 | | 12/2005 | Wu | |
| 2006/0186131 | A1 | | 8/2006 | Panning | |
| 2007/0081803 | A1 | | 4/2007 | Lindsay et al. | |

FOREIGN PATENT DOCUMENTS

| | | | |
|---|---|---|---|
| EP | 0 744 357 | B1 | 10/2000 |
| WO | WO 93/17933 | A | 9/1993 |
| WO | WO 99/06311 | A | 2/1999 |
| WO | WO 2006/071279 | A | 7/2006 |

OTHER PUBLICATIONS

International Search Report, dated Aug. 28, 2008, 4 pages.

International Search Report, dated Dec. 29, 2008, 6 pages.

* cited by examiner

CLEANSING WIPE CONTAINER HAVING CONTENT-SPECIFIC DISPLAY

FIELD OF THE INVENTION

The present disclosure generally relates to product dispensers that dispense cleansing wipes and, more particularly, to product a dispenser that cooperates with a cleansing wipe cartridge to display a content-specific message regarding the cleansing wipes housed in the cartridge.

BACKGROUND OF THE INVENTION

Cleansing wipes generally are sold in plastic tubs, tubes or other containers, and a user typically extracts a wipe for use by pulling the wipe through a hole or slot in the container. Preferably, the hole or slot is covered by a lid. Commonly, the plastic container or tub is sold pre-loaded with a supply of wipes. Once a consumer depletes the original supply of wipes, the user may discard the empty container and purchase a new pre-loaded container or tub. Of course, discarding the empty containers and purchasing new containers just to get a new supply of wipes tends to waste a considerable amount of material, especially plastic. Further, retailers must set aside a great deal of shelf space in order to stock enough pre-loaded containers or tubs to meet demand.

To address some of these problems, manufacturers have recently introduced products that reuse the original wipes container. Instead of stocking exclusively pre-loaded containers or tubs, retailers now can stock a supply of pre-loaded containers, along with a supply of refill cartridges. Typically, these refill cartridges are made out of a lower cost packaging material. Consequently, retailers can stock many more refill cartridges than pre-loaded containers for a given shelf space, thus making better use of the available retail space. Also, because the cleansing wipes are substantially uniform in size and shape across different manufacturers, most refill cartridges made by one manufacturer can be used with the containers or tubs of other manufacturers.

Furthermore, because of widely differing consumer tastes, manufacturers tend to make a wide variety of cleansing wipes. For example, some consumers desire scented wipes, while other consumers demand wipes that are free of all dyes, scents, or perfumes. Still other consumers desire wipes having lotions such as aloe vera, lanolin, or other materials, often with or without the addition of alcohol. Still other consumers want gentle wipes, or wipes free of any lotion, alcohol, or other additives. However, because the plastic containers that hold the wipes are typically opaque and colored, the wipes within the containers must be identified by a label on the exterior of the container. Thus, it is possible for a consumer to mismatch the type of wipe in a refill cartridge with the type of label on the container, resulting in a situation where a consumer may not know what type of wipe is in the container.

SUMMARY OF THE INVENTION

A cleansing wipe container is disclosed that bears a content-specific message. The container includes a bottom panel, a top panel, and a surrounding sidewall, the container also includes a lid covering an opening, the opening providing access to an interior of the container. The container also has a viewing area for viewing a content-specific message from outside the container. The container receives a wipes cartridge that includes a plurality of cleansing wipes and a packaging that substantially encloses the plurality of cleansing wipes. The wipes cartridge and container are arranged to cooperate with one another to display a content-specific message in the viewing area, the content-specific message describing a characteristic of a type of cleansing wipes in the wipes cartridge.

While the specification concludes with claims particularly pointing out and distinctly claiming the subject matter that is regarded as the present invention, it is believed that the invention will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings are necessarily to scale.

DETAILED DESCRIPTION OF THE INVENTION

Figure 1:
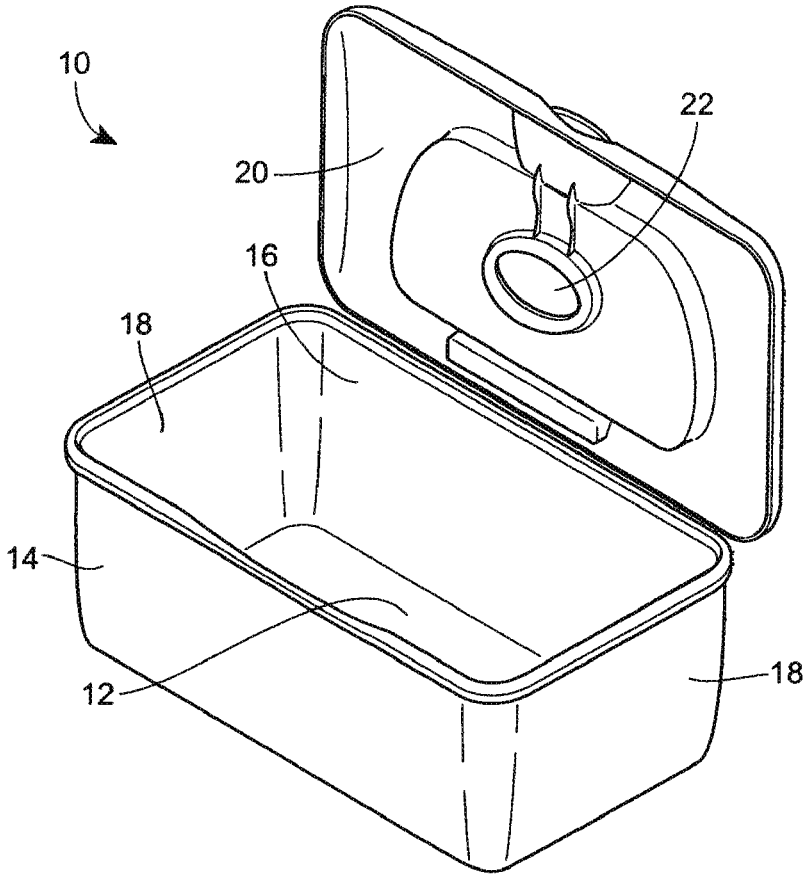
FIG. 1 is a perspective view of a prior art cleansing wipe container with an open lid.
Figure 2:
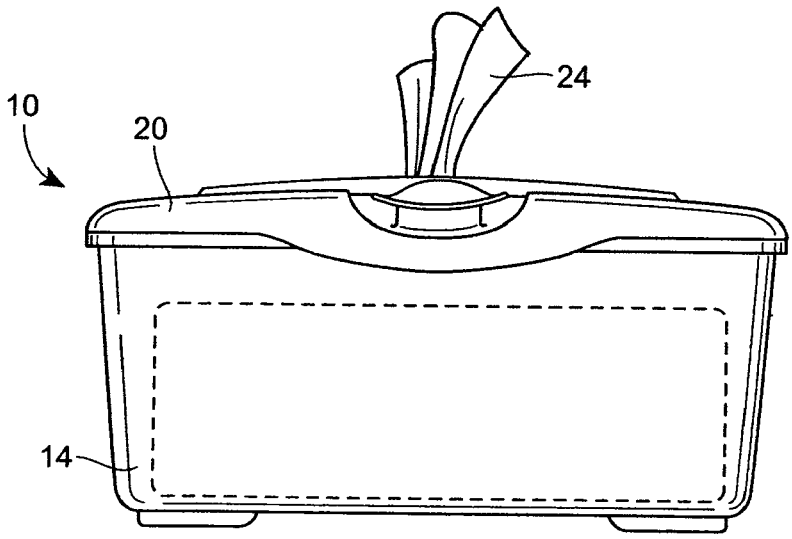
FIG. 2 is a front view of the prior art cleansing wipe container of FIG. 1 with a closed lid and a wipe extending through the lid and ready for use.
Figure 3:
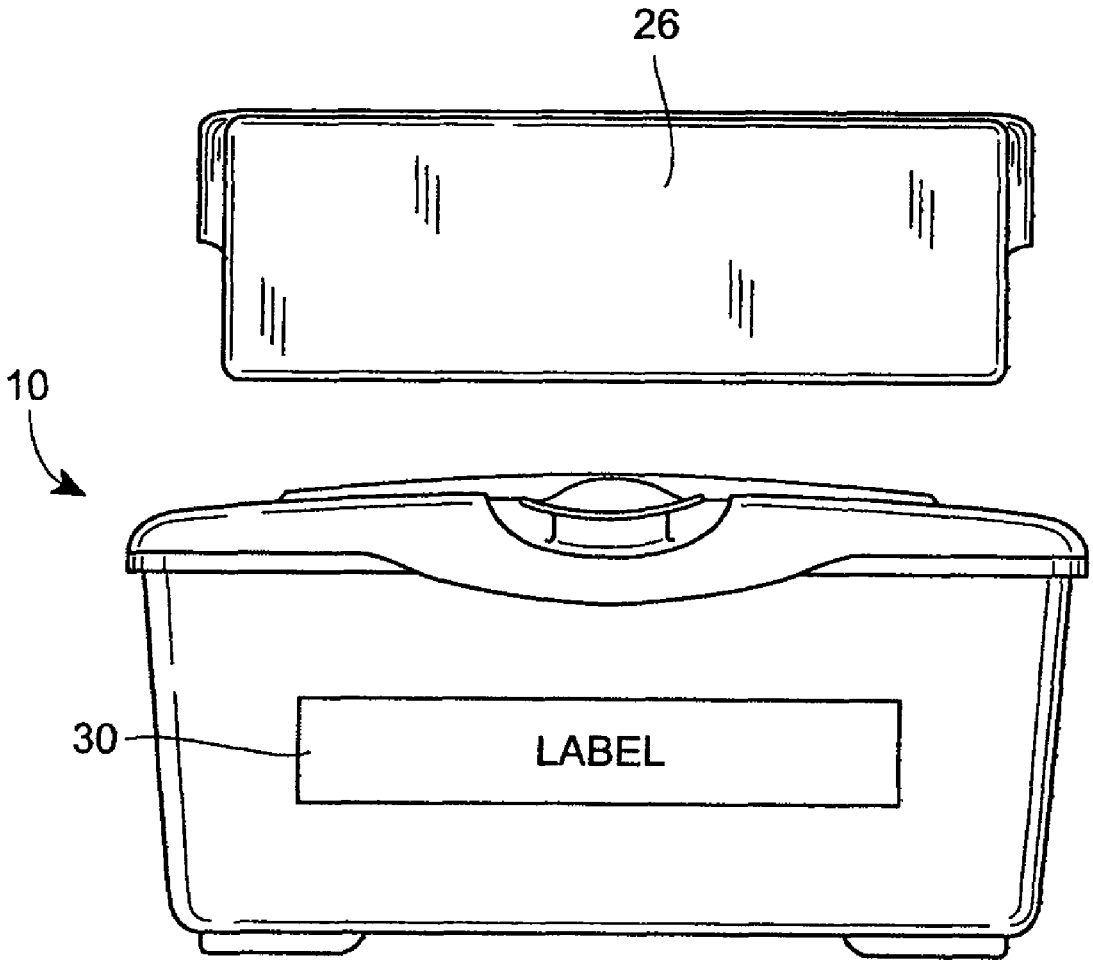
FIG. 3 is a front view of the cleansing wipe container of FIG. 1 and a refill cartridge.

Known cleansing wipe containers 10, shown in FIGS. 1-3, generally include a bottom panel 12, a front panel 14, a rear panel 16, and a pair of side panels 18. A lid 20 is hingedly connected to the rear panel 16. A storage space is defined above the bottom panel 12 and between the front, back and side panels 14, 16, 18. The lid 20 usually includes an aperture 22 through which cleansing wipes 24 are extracted from the container 10 when the lid 20 is closed (see FIG. 2). When a supply of cleansing wipes is depleted within the container 10, the container 10 may be refilled with a cartridge 26 that includes a plurality of cleansing wipes. The container 10 is typically made of an opaque plastic material and may include a label 30 on the front panel 12 (See FIG. 3). The label 30 may describe the type of cleansing wipes 24 in the container 10, ingredients used in the cleansing wipes 24 and/or instructions for using the cleansing wipes. The label 30 is generally made of a paper or plastic material that is adhesively attached to the front panel 12. As a result, if a consumer wishes to change the type of wipes being used, a new container 10 (with a new label 30) must be purchased to reflect the new type of wipe within the container 10.

Figure 4:
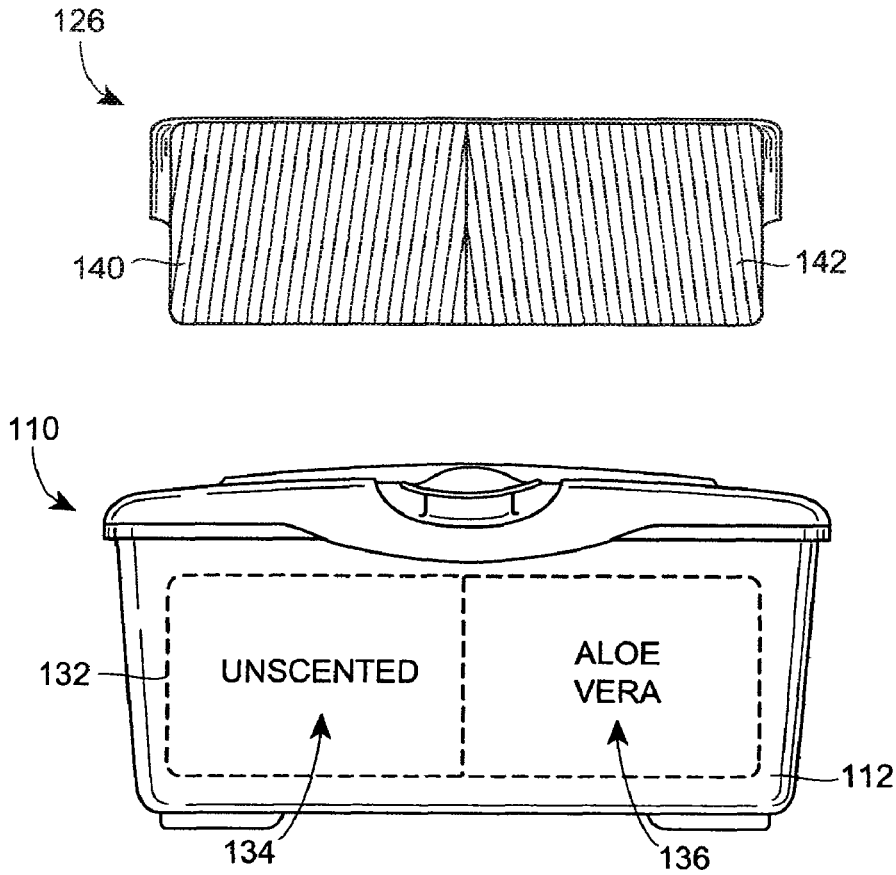
FIG. 4 is a front view of a cleansing wipe container and refill cartridge constructed in accordance with the teachings of the disclosure.
Figure 5:
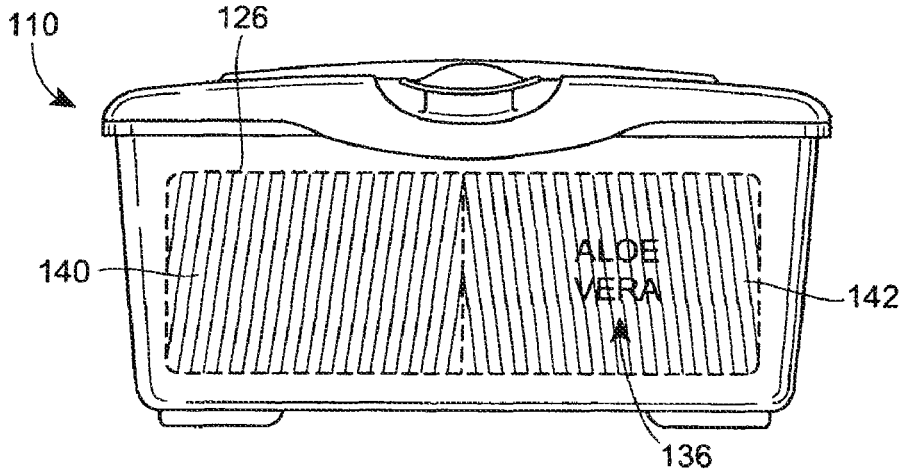
FIG. 5 is a front view of the cleansing wipe container and refill cartridge of FIG. 4, with the refill cartridge disposed in the container.

A cleansing wipe container 110 and cartridge 126 constructed in accordance with the teachings of this disclosure are shown in FIGS. 4-8. Turning to FIGS. 4-5, a first embodiment of a cleansing wipe container 110 and cartridge 126 are shown. The cleansing wipe container 110 has at least one translucent or transparent panel (or portion of a panel), in this embodiment, the front panel 112 is translucent. However, any panel, or all panels of the container 110 could be translucent or transparent. Further, a viewing area 132 includes one or more content specific messages 134, 136 printed in the viewing area 132. The one or more content specific messages 134, 136 may describe a characteristic of the wipes in the cartridge 126. For example, the content-specific messages 134, 136 may describe the type of wipes, the ingredients in the wipes, instructions for using the wipes, or the amount of wipes. More than one viewing area 132 may be provided if desired. The one or more content specific messages 134, 136 are printed in similar colors of ink on an inner surface of the front panel 112. However, the one or more content specific messages 134, 136 may be printed on an outer surface of the front panel 112 or may be incorporated within the front panel 112. In the embodiment of FIGS. 4 and 5, the content specific messages 134, 136 are printed in blue ink.

Alternatively, the viewing area 132 may be a transparent plastic sheet having a tint. For example, the transparent plastic sheet may have a red tint. The cartridge 126 may have a content specific message printed in one of the zones in a color other than the color of the transparent plastic sheet. Thus, the transparent plastic sheet filters all colors of light (other than the color of the tint) and the content-specific message appears in the viewing area 132 as black letters.

The cartridge 126 includes two color zones 140, 142 on one side thereof. At least one of the two color zones 140, 142 is substantially the same color as the content specific messages 134, 136. In this embodiment, the first color zone 140 is blue and the second color zone 142 is red. When arranging the cartridge 126 in an upright position and inserting the cartridge 126 into the container 110, as shown in FIG. 5, only one content specific message 136 is visible through the front wall 136 of the container 110. The content specific message 136 is viewable because of the contrast in color between the content specific message 136 (blue in color) and the second color zone 142 (red in color). As a result, the human eye detects the blue print of the content specific message 136. To the contrary, the content specific message 134 (also blue in color) is surrounded by the first color zone 140 (blue in color), thus the human eye cannot distinguish the blue content specific message 134 from the blue color zone 140. As a result of this arrangement, only one content specific message 136 is visible in the viewing area 132. By changing the colors of the first color zone 140 and the second color zone 142 on the cartridge 126, a predetermined content specific message 134, 136 appears in the viewing area 132. This content specific message 134, 136 displays the type of wipe in the cartridge 126, the ingredients of the wipes in the cartridge 126, and/or instructions for using the wipes in the cartridge 126. Any combination of ink and zone color may be used. For example, black ink and black and white zone colors may be used to ensure that colorblind individuals can see the content specific message.

This unique combination of container 110 and cartridge 126 allows a single container 110 to receive different types of cartridges 126 while accurately displaying the contents of the cartridge 126 to a user based on the packaging of the cartridges 126. Thus, the container could be made nearly universal such that the retailer need only stock one type of container 110. This ability would greatly simplify manufacturing and inventory management.

Figure 6:
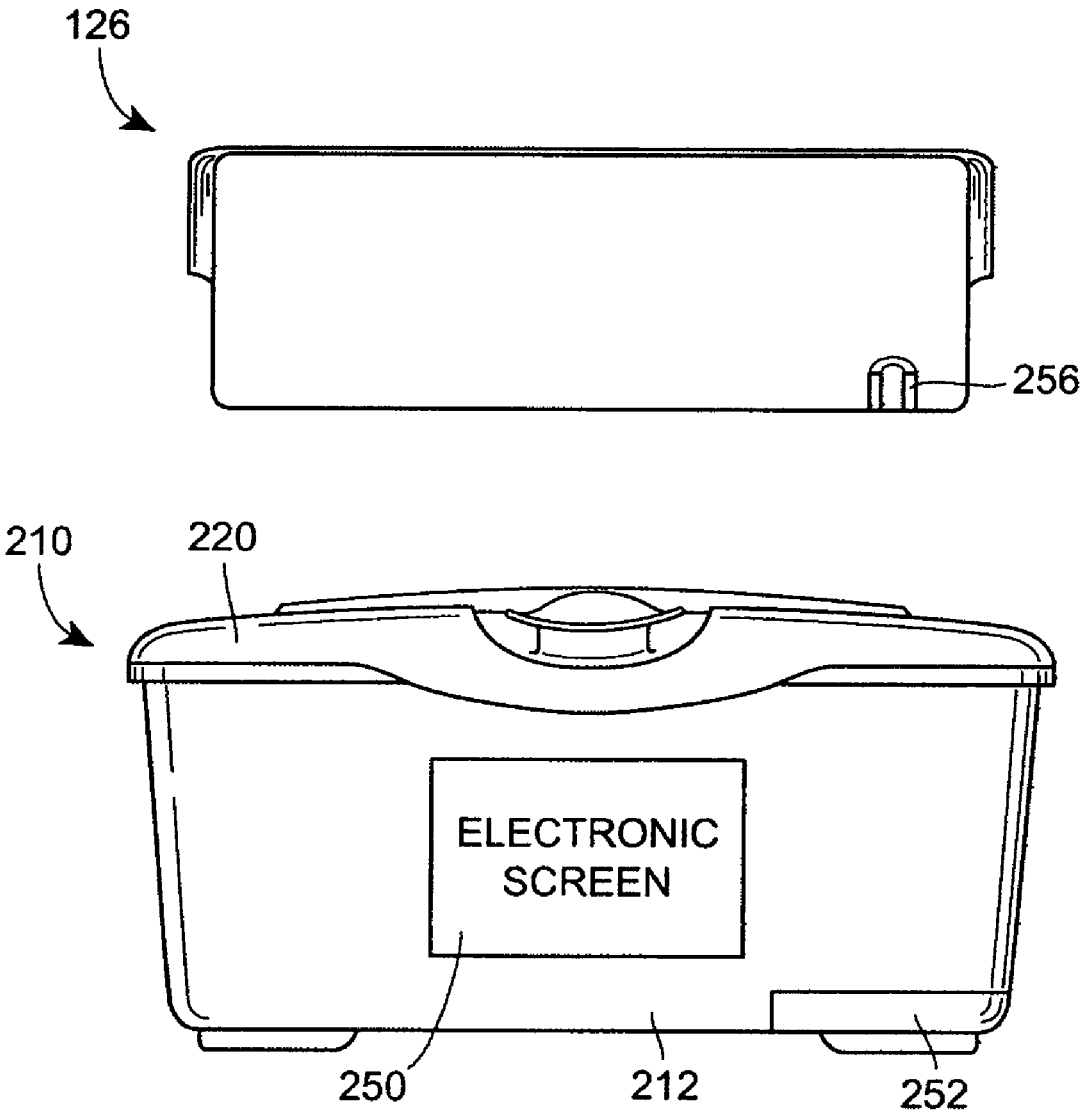
FIG. 6 is a front view of another cleansing wipe container and refill cartridge constructed in accordance with the teachings of the disclosure.
Figure 7:
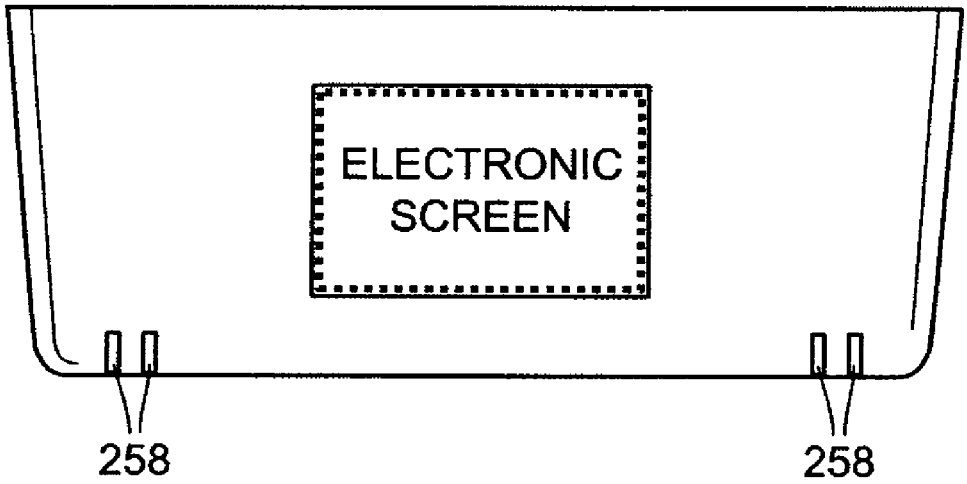
FIG. 7 is an inside view of the front wall of the plastic wipe container of FIG. 6.
Figure 8:
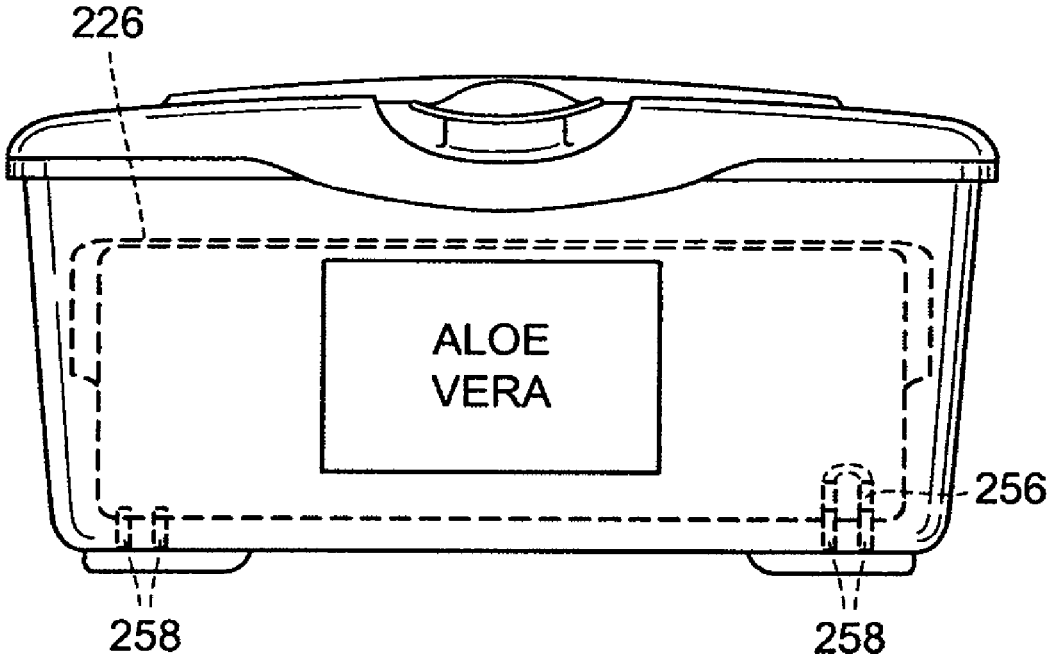
FIG. 8 is a front view of the cleansing wipe container and refill cartridge of FIG. 6 with the refill cartridge disposed in the container.

A second embodiment of a container 210 and cartridge 226 is shown in FIGS. 6-8. The viewing area 232 includes a viewing area that is electricity-driven in the form of an electronic screen 250 on the front wall 212. However, the electronic screen 250 could be placed on any wall of the container 210, or on the lid 220. Further, the electricity-driven viewing area need not be a screen, but could be any electricity-driven indicator. The electronic screen 250 is powered by one or more batteries 252. The batteries are disposed on or in the container 210. Generally, a small watch battery supplies sufficient power for the electronic screen 250. However, virtually any type of battery may be used to power the electronic screen 250. The electronic screen 250 in this embodiment is a liquid crystal display. Alternatively, the electronic screen 250 may include individual light bulbs or light diodes that illuminate to form a content specific message.

Alternatively, the electricity-driven indicator may be used to indicate which of a number of printed messages is specific to the cartridge's product contents. Individual light bulbs or light diodes within a plurality of light bulbs or light diodes located adjacent to or in proximity to an appropriate corresponding printed message may be used to indicate which features, from an array of possible features, are specific to the cartridge's product contents. Alternately, a moving "pointer" or other non-illuminating indicator may be used to indicate which features, from an array of possible features, are specific to the cartridge's product contents. It can be appreciated by one of ordinary skill in the art that any one of a number of means of using an electricity-driven indicator to indicate the specific product contents of the cartridge may be used.

The cartridge 226 includes one or more electronic contacts 256. These contacts 256 complete a circuit in the container 210 that determines the content specific message to be displayed on the electronic screen 250. The completion of this circuit may be accomplished by any one of a number of means. As shown in FIG. 7, a plurality of electronic contacts 258 is disposed on an inner surface of the front wall 212. This plurality of electronic contacts 258 on the inner surface of the front wall 212 interacts with the electronic contacts 256 on the cartridge 226 to complete various circuits. Each circuit produces a particular content specific message on the electronic screen 250. As a result, the interaction of the electronic contacts 256 on the cartridge 226 with the plurality of electronic contacts 258 on the front wall 212 determines which circuit or circuits are completed and thus which particular content specific messages are displayed in the electronic screen 250.

Alternately, the circuit may be completed by means of a magnetic switch. In this instance, the cartridge 226 includes one or more magnetic elements, consisting of either a magnet or an element that is attracted by a magnet, such as a second magnet or a piece of metal. The magnetic elements on the cartridge complete a circuit in the container 210 that determines the content specific message to be displayed. The container, then, would include a plurality of electronic circuits including a "switch" that can be activated by the proximity of the cartridge's magnetic element. Which of the various circuits would be activated by the cartridge would, then, be determined by the dispositions of the cartridge's magnetic elements.

It can be appreciated by one of ordinary skill in the art that any one of a number of means of selectively completing a circuit within the container 210 by way of the cartridge 226 is possible.

Such a result is shown in FIG. 8, where the contacts 256 on the cartridge 226 complete a circuit with the contacts 258 on the front wall 212 (on the right side of FIG. 8), the completed circuit produces the content specific message "Aloe Vera" on the electronic screen 250. Thus, the content specific message displayed on the electronic screen 210 is determined by the contacts 256 on the cartridge 226.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleansing wipe container bearing a content-specific message and comprising:

a container defined by a bottom panel, a top panel, and a surrounding sidewall, the container including a lid covering an opening, the opening providing access to an interior of the container, the container having a viewing area for viewing a content-specific message from outside the container;

a wipes cartridge including a plurality of cleansing wipes and a packaging that substantially encloses the plurality of cleansing wipes, the wipes cartridge including a zone of a first color; and a content-specific message printed in a second color within bounds of the viewing area describing a characteristic of a type of cleansing wipes in the wipes cartridge, wherein the second color of the content-specific message contrasts with the first color of the zone of the wipes cartridge such that the content-specific message is viewable in the viewing area from outside of the container when the cartridge is disposed inside the container.

2. The cleansing wipe container of claim 1, wherein the viewing area is one of translucent and transparent.

3. The cleansing wipe container of claim 2, wherein the content-specific message is printed on an inner surface of the container and adjacent to the viewing area, the content-specific message being printed in the second color, the cartridge including a first zone of the first color and a second zone of a second color, the second color contrasting with the first color.

4. The cleansing wipe container of claim 3, wherein the first color and the second color are selected from the group consisting of blue, red, black and white.

5. The cleansing wipe container of claim 1, wherein the viewing area is a first viewing area, the container further comprising a second viewing area, the wipes cartridge including a first zone and a second zone, and wherein the content-specific message comprises a first message carried by the first zone and visible in the first viewing area or a second message carried by the second zone and visible in the second viewing area.

6. The cleansing wipe container of claim 5, wherein the first viewing area has a blue color and the second viewing area has a red color.

7. The cleansing wipe container of claim 6, wherein the content-specific message has a red color.

8. The cleansing wipe container of claim 6, wherein the content-specific message has a blue color.

9. The cleansing wipe container of claim 1, wherein the content-specific message identifies an ingredient of the cleansing wipes in the cartridge.

10. The cleansing wipe container of claim 1, wherein the content-specific message includes instructions for using the cleansing wipes in the cartridge.

11. A wipes container and cartridge bearing a content-specific message, comprising:

a container comprising a viewing area, the viewing area being transparent and having a color tint for selectively filtering certain wavelengths of light;

a cartridge containing a plurality of wipes disposed in the container; and the cartridge including multiple zones where each zone includes a different written message such that only one written message is positioned adjacent the viewing area when the cartridge is disposed in the container, the only one written message having a color other than the color of the tinted viewing area, wherein the tinted viewing area selectively filters certain wavelengths of light thus allowing the only one written message to be viewed through the viewing area as a plurality of black letters.

12. A method of producing a content-specific message on a wipes container, the method comprising:

providing a container having a translucent portion;

printing a written message in a first color on an interior wall of the container and adjacent the translucent portion; and providing a cartridge having a first zone of the first color and a second zone of a second color, wherein the second color contrasts with the first color to produce the content-specific message readable from outside the container through the translucent portion, the content-specific message depending upon the relative position of the first and second zones to the translucent portion.

* * * * *